US010502537B1

(12) United States Patent
Sapp et al.

(10) Patent No.: US 10,502,537 B1
(45) Date of Patent: Dec. 10, 2019

(54) ENHANCED TERMINAL PERFORMANCE MEDIUM CALIBER MULTIPURPOSE TRACED SELF-DESTRUCT PROJECTILE

(71) Applicant: U.S. Government as Represented by the Secretary of Army, Picatinny Arsenal, Dover, NJ (US)

(72) Inventors: Nicole Sapp, Augusta, NJ (US); Jeffrey Darbig, Flanders, NJ (US); Jonathan Escobar, Stony Point, NY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/165,366

(22) Filed: Oct. 19, 2018

Related U.S. Application Data

(60) Provisional application No. 62/574,794, filed on Oct. 20, 2017.

(51) Int. Cl.

| | |
|---|---|
| ***F42B 12/20*** | (2006.01) |
| ***F42B 12/38*** | (2006.01) |
| ***F42C 1/10*** | (2006.01) |
| ***F42B 12/06*** | (2006.01) |
| ***F41H 11/02*** | (2006.01) |

(52) U.S. Cl.
CPC ..... *F42B 12/208* (2013.01); *F42B 12/06* (2013.01); *F42B 12/38* (2013.01); *F42C 1/10* (2013.01); *F41H 11/02* (2013.01)

(58) Field of Classification Search
CPC ..... F42B 12/06; F42B 12/207; F42B 12/208; F42B 12/38; F42B 12/204; F42C 1/10
See application file for complete search history.

(56) References Cited

U.S. PATENT DOCUMENTS

| | | | | | |
|---|---|---|---|---|---|
| 2,922,366 | A * | 1/1960 | Lyon | F42B 12/08 | 102/398 |
| 3,633,512 | A * | 1/1972 | Schlack | F42B 12/38 | 102/513 |
| 3,677,181 | A * | 7/1972 | Giljarhus | F42B 12/204 | 102/364 |
| 3,731,630 | A * | 5/1973 | Muller | F42B 12/06 | 102/518 |
| 3,877,378 | A * | 4/1975 | Clark | F42C 9/148 | 102/207 |

(Continued)

FOREIGN PATENT DOCUMENTS

| | | | | |
|---|---|---|---|---|
| DE | 3424237 A1 * | 1/1986 | ..... | F42B 12/06 |
| EP | 0227126 A1 * | 7/1987 | ..... | F42B 12/06 |

(Continued)

*Primary Examiner* — Joshua T Semick
(74) *Attorney, Agent, or Firm* — John P. DiScala

(57) ABSTRACT

An ammunition round comprises an optimized projectile incorporating a hardened penetrator and an explosive self-destruct mechanism for a medium caliber high rate of fire round. The ammunition round incorporates a hardened segment penetrator followed by a pyrotechnically initiated high explosive warhead that substantially increases the effective range and terminal performance against RAM targets. The hardened segment penetrator localizes the kinetic energy of the projectile to increase target penetration prior to the initiation of the high explosive warhead.

20 Claims, 4 Drawing Sheets

(56) References Cited

U.S. PATENT DOCUMENTS 4,419,936 A * 12/1983 Coates ..... C06C 9/00 102/364
4,437,409 A * 3/1984 Freymond ..... F42B 12/06 102/364
4,574,702 A * 3/1986 Brandt ..... F42B 10/48 102/244
4,648,324 A * 3/1987 McDermott ..... F42B 12/06 102/364
4,736,686 A * 4/1988 Martin ..... F42B 12/08 102/351
4,757,765 A * 7/1988 Strandli ..... F42C 1/10 102/477
4,961,382 A * 10/1990 Bai ..... F42B 12/08 102/476
4,970,960 A * 11/1990 Feldmann ..... F42B 12/06 102/491
5,121,691 A * 6/1992 Nicolas ..... F42B 12/204 102/205
5,945,629 A * 8/1999 Schildknecht ..... F42B 12/204 102/273
6,119,600 A * 9/2000 Burri ..... F42B 12/78 102/518
6,272,998 B1 * 8/2001 Strandli ..... F42B 12/38 102/473
7,503,261 B2 * 3/2009 Burri ..... F42B 12/06 102/504
7,661,363 B2 * 2/2010 Cotet ..... F42C 11/02 102/210
8,250,987 B1 8/2012 Morley
8,640,624 B1 2/2014 Hassan
9,329,008 B1 5/2016 Gilbert
10,081,057 B2 * 9/2018 Burrow ..... C22C 38/58
2002/0011173 A1 * 1/2002 Schildknecht ..... F42C 1/10 102/478
2004/0069176 A1 * 4/2004 Kellner ..... F42B 12/204 102/476
2010/0199875 A1 * 8/2010 Weihrauch ..... F42B 12/208 102/492
2012/0216699 A1 8/2012 Fanucci

FOREIGN PATENT DOCUMENTS

GB 708351 A * 5/1954 ..... F42C 1/06
GB 749473 A * 5/1956 ..... F42C 1/06

* cited by examiner

ENHANCED TERMINAL PERFORMANCE MEDIUM CALIBER MULTIPURPOSE TRACED SELF-DESTRUCT PROJECTILE

CROSS-REFERENCE TO RELATED APPLICATIONS

This application claims the benefit under 35 USC § 119(e) of U.S. provisional patent application 62/574,794 filed on Oct. 20, 2017.

STATEMENT OF GOVERNMENT INTEREST

The inventions described herein may be manufactured, used and licensed by or for the United States Government.

BACKGROUND OF THE INVENTION

The invention relates in general to ammunition and in particular to medium caliber ammunition.

Military installations face increased risk from rockets, artillery, and mortar (RAM) threats. To protect against these threats, Counter rocket, artillery and mortar (C-RAM) systems are employed to engage incoming RAM threats. The need for increased performance from C-RAM systems arises as new or improved threats emerge.

One medium caliber ammunition currently used in C-RAM systems was initially developed as an anti-aircraft munition and optimized to destroy thin skinned targets. As such, the activation mechanism in the round is sensitive and may initiate the high explosive in the warhead prior to penetration into RAM targets. Another round currently used by naval systems for a similar mission utilizes a sub-caliber tungsten penetrator to increase performance; however, this solution lacks a self-destruct mechanism which is necessary for a land-based system to ensure unengaged falling rounds do cause unintended damage.

Accordingly, a need exists for a medium caliber cartridge solution that targets emerging RAM threats with improved penetration and detonation delay. Additionally, the ammunition requires tracer and self-destruct features for use in a land-based system.

SUMMARY OF INVENTION

One aspect of the invention is an ammunition round having an optimized projectile incorporating a hardened penetrator and an explosive self-destruct mechanism for a medium caliber high rate of fire round. The ammunition round incorporates a hardened segment penetrator followed by a pyrotechnically initiated high explosive warhead that substantially increases the effective range and terminal performance against RAM targets. The hardened segment penetrator localizes the kinetic energy of the projectile to increase target penetration prior to the initiation of the high explosive warhead.

Another aspect of the invention is a projectile for an ammunition round. The projectile comprises a nose assembly, a warhead assembly and a tracer charge. The assembly includes a nose cap, a hardened segmented penetrator and a closure plug. The hardened segmented penetrator is positioned within the nose cap. The hardened segmented penetrator further comprises a penetrator tip and three cylindrical penetrator bases aligned along a longitudinal axis with the three penetrator bases defining a hollow interior. The closure plug secures the hardened segmented penetrator within the nose cap and is aligned with the hardened segmented penetrator. The warhead assembly is rearward of the nose assembly and further comprises a body and a dual purpose explosive charge assembly. The body which partially receives the nose assembly. The dual purpose explosive charge assembly is housed within the body. The dual purpose explosive charge assembly extends the ballistic effect of the projectile when a target is engaged and self destructs the projectile when a target is not engaged. The tracer assembly housed within a cavity in the base of the body and: further comprises a tracer charge for tracing a projectile trajectory and initiating the dual purpose explosive charge when a target is not engaged.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

Figure 1:
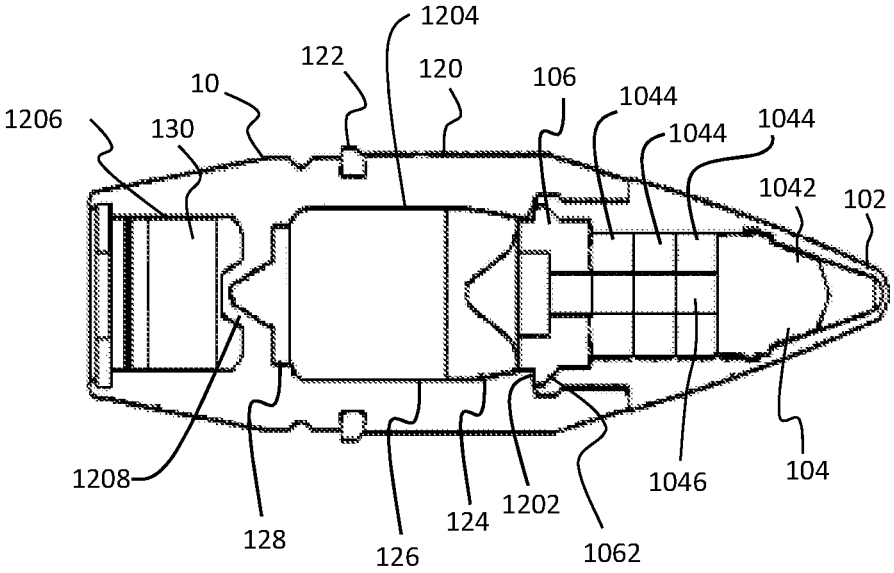
FIG. 1 is a side cross-sectional view of a medium caliber multi-purpose traced self-destruct projectile with a four piece solid penetrator design, in accordance with one embodiment.

A medium caliber high rate of fire ammunition round includes an optimized projectile incorporating a hardened segmented penetrator and an explosive self-destruct mechanism, This combination of hardened penetrator and self-destruct mechanism satisfies the dual needs of increased lethality with minimization of unintended harm. The self-destruct mechanism, in particular, is required for use in U.S. military land based C-RAM systems and allows for use over friendly forces.

The hardened segmented penetrator and the precisely tuned synergy between the segmentation penetrator, closure plug and the explosive warhead to appropriately time the initiation of the explosive are key to effectiveness. The hardened segmented penetrator is followed by a pyrotechnically initiated high explosive warhead that substantially increases the effective range and terminal performance against RAM targets. The hardened segment penetrator localizes the kinetic energy of the projectile to increase target penetration prior to the initiation of the high explosive warhead.

The projectile integrates a unique forward nose assembly that includes a hardened segmented penetrator and engineered closure plug. This combination of specifically designed projectile features can be leveraged across all medium caliber ammunition with a similar mission. This segmentation of the penetrator reduces collateral damage on nearby infrastructure from rounds that do not engage the target and undergo self-destruct. The segmented penetrator, although made up of multiple pieces, acts like a solid mass when engaging the target.

The penetrator ensures that the round penetrates the hardened targets without premature initiation of the high explosive warhead and that the high explosive initiates only after penetration into the hardened target. This allows for improved terminal performance of the high explosive once initiated within the target.

The lead penetrator section is specifically designed to increase oblique angle penetration onto the target surface and ensure that the round does not ricochet off of the target during engagement. This penetrator can be arranged in multiple configurations and could utilize any number of segments based on the ammunition ballistic and terminal requirements. Further, the lead penetrator segment can be solid or hollow. A hollow lead penetrator allows for the inclusion of a small amount of incendiary which makes the round much more versatile. The incendiary allows for initiation of the round on softer aluminum targets in addition to providing the extra penetration capabilities of the hardened penetrator needed to defeat the larger targets, The base penetrator segments are hollow to allow pressure from the explosive to rupture the ogive during self-destruction. This allows for the capability to reduce projectile fragments to non-lethal impact limits.

In embodiments of the invention, the hardened segmented penetrator is manufactured with materials including heavy tungsten alloy, reactive material and alloy steel. However, the hardened segmented penetrator is not limited to being manufactured from among these materials.

The closure plug between the penetrator and projectile body translates the target impact forces to appropriately initiate the high explosive payload to maximize terminal performance. The closure plug geometry and composition can be tailored to optimize the initiation timing of the warhead and to provide additional penetration capability.

As described in further detail below, there are multiple embodiments of the projectile. Four embodiments are shown and described below which utilize a 20×120 mm cartridge configuration as a demonstration. platform. However, the projectile is not limited to use within a 20×120 mm cartridge configuration. Further while the projectile is particularly suited for a medium caliber C-RAM system, the projectile is not limited to C-RAM roles or to medium caliber ammunition. The projectile may be employed in a small caliber ammunition round or large caliber ammunition round.

Tests performed on ammunition rounds incorporating the projectile have shown dramatic improvement over legacy solutions. The inclusion of the hardened segmented. penetrator and the dynamic interaction of the closure plug provides dramatically increased performance on large rockets and mortars compared to legacy solutions including the M940 ammunition round.

FIG. 1 is a side cross-sectional view of a medium caliber multi-purpose traced self-destruct projectile with a four piece solid penetrator design, in accordance with one embodiment. The projectile 10 comprises a forward nose assembly, a warhead assembly and a tracer assembly. The forward nose assembly is sized and dimensioned to be partially received into a corresponding opening in the warhead assembly, The tracer assembly is entirely housed within an opening in the rear of the warhead assembly.

The forward nose assembly further comprises a nose cap 102 and a hardened segmented penetrator 104 including a penetrator tip 1042 and one or more penetrator bases 1044 and a closure plug 106. The nose cap 102 includes internal threads to support the threaded hardened segmented penetrator 104 and to efficiently transfer launch loads to the projectile body 120. The nose cap 102 provides an aerodynamic surface and houses the hardened segmented penetrator 104 during flight. The nose cap 102 is formed of a material with increased hardness when compared to legacy solutions. This allows for proper assembly and rigidity during launch while still allowing the penetrator 104 to break up during self-destruct to minimize collateral damage.

The hardened segmented penetrator 104 comprises a penetrator tip 1042 and one or more penetrator bases 1044. The hardened segmented penetrator 104 may be manufactured from among multiple materials including heavy tungsten alloys, reactive material and alloy steel.

The penetrator tip 1042 may be made of multiple materials and is specifically designed to dig into the outer casing of the target and prevent the round from ricocheting off of the target, In the embodiment shown in FIG. 1, the penetrator tip 1042 is made of a heavy metal, such as a tungsten alloy. The penetrator tip shown in FIG. 1 is generally conical in shape and forming a point at the forward end, or the end closest to the nose of the projectile. The penetrator tip 1042 is positioned forward of and aligned with the one or more penetrator bases 1044.

The one or more penetrator bases 1044 add to the mass and rigidity of the penetrator 104 during launch. There can be multiple penetrator bases 1044 which are stacked next to each other and designed to break apart. For example, while the embodiment shown in FIG. 1 includes four penetrator bases 1044, the projectile 10 is not limited to four penetrator bases 1044 and may include more than or less than four depending on application and desired performance. in the embodiment. shown, the one or more penetrator bases 1044 are annular cylindrical discs with the central hole which aids in self-destruct performance. When the bases 1044 are assembled in series, the holes align to form a hollow central cavity 1046. As will be described below, during self-destruct, the hollow central cavity 1046 is filled with high pressure gases which cause the segmented penetrator 104 to break apart.

The closure plug 106 retains the segmented penetrator 104 within the forward nose assembly and separates the segmented penetrator 104 from the warhead body. The closure plug 106 can be made of multiple materials chosen to increase the mass of the projectile 10 and move the center of gravity back. Having a center of gravity closer to the center of the projectile 10 positively effects the dispersion and accuracy of the round. The closure plug 106 can also be hollow, solid, or tailored to the specific projectile configuration. As will be described further below, alternate closure plug 106 geometries enhance the interaction with the explosive train and cause the explosive to react with more energy.

The warhead assembly is rearward of the nose cap assembly. The warhead assembly further comprises a body 120, a driving band 122, an initiating charge 124, an explosive charge 126 and a self-destruct initiation charge 128. The driving band 122 extends around the outer circumference of the warhead body 120.

The warhead body 120 is generally hollow with two interior cavities, a main interior volume 1204 accessed from an opening in the front of the body and another cavity 1206 accessed by an opening in the base of the projectile 10. The opening in the front of the warhead body is sized to partially receive the nose cap assembly. The opening further comprises a rim 1202 which serves as a mating surface to the support rim 1062 of the closure plug 106.

The remaining main interior volume 1204 is filled by an initiating charge 124, an explosive charge 126 and a self-destruct initiation charge 128. The explosive charge 126 is in communication with both the initiating charge 124 and the self-destruct initiation charge 128, with the initiating charge 124 forward of the explosive charge 126 and the self-destruction initiation charge 126 rearward of the explosive charge 128.

A cavity 1206 in the base of the warhead body 120 contains the tracer assembly. The tracer assembly is exposed to the exterior environment through an opening in the base. The tracer assembly further comprises a tracer charge 130.

In operation, a medium caliber ammunition round comprising the projectile 10 is fired from a weapon, usually by electrical or procession initiation. The projectile 10 is initially seated within a cartridge case further comprising a primer charge and a propelling charge, The initiation ignites the primer charge, Which in turn ignites the propellant charge. The propellant burns rapidly to build pressure in the cartridge case and accelerates the projectile 10 down the barrel of the weapon. After the projectile 10 is in motion down the barrel, the projectile 10 exits the barrel and flies toward the target.

Upon firing, the tracer charge 130 is initiated by the burning propellant. During a portion of the flight, the tracer charge 130 emits a visible signature through the opening in the base thereby giving an indication of the path of the projectile 10.

Upon engagement with a target, the nose cap of the projectile 10 deforms to expose the penetrator tip 1042 to initiate penetration into the target. The hardened segmented penetrator 104 localizes the kinetic energy of the projectile 10 to increase target penetration. During the penetration event, the impact forces cause the closure plug support rim 1062 to fail which in turn begins the chain for initiation of the explosive charge 126 of the projectile. Once the support rim 1062 fails, the impact forces the closure plug 106 to travel rearward and contact the impact sensitive initiating charge 124. After a delay to allow full entry into the main body of the target, the high explosive 126 is fully initiated by the initiating charge 124. The geometries and material properties of the projectile 10 and their interaction with each other, including the segmented penetrator tip 1042 and bases 1044, closure plug 106 and charges 124, 126, are tailored such that the high explosive charge 126 inflicts maximum damage to the target by delaying the high explosive detonation until the projectile 10 penetrates the target.

After a predetermined time, if the projectile 10. does not engage a target, the self-detonation initiating charge inmates the high explosive charge, the detonation of which causes the projectile 10 to break apart including the segmented penetrator 104. The projectile 10 continues its trajectory for a set duration of time until the pyrotechnic delay tracer charge 130 burns down. The burning of the tracer charge heats a thin web of metal in the projectile body. The heated web of metal, in turn, lights a self-destruct initiating charge 128, a pyrotechnic booster, and ultimately the high explosive charge 126. The pressure from the explosive reaction self-destructs the projectile body 120 and fills the hollow cavity 1046 of the penetrator 104 to break-up the forward nose assembly, including the segmented penetrator 104, into non-lethal components.

Figure 2:
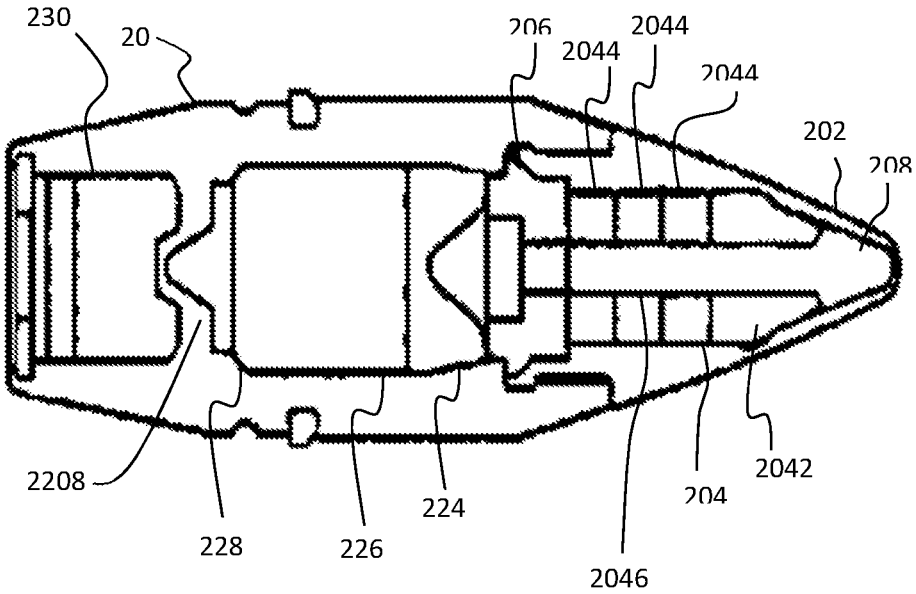
FIG. 2 is a side cross-sectional view of a medium caliber multi-purpose traced self-destruct projectile with a hollow penetrator with incendiary, in accordance with one embodiment.

FIG. 2 is a side cross-sectional view of a medium caliber multi-purpose traced self-destruct projectile with a hollow penetrator and incendiary charge, in accordance with one embodiment. When engaging certain targets, such as targets with thin skin, it may not be desirable to initiate the explosive by contact With the closure plug. Retaining a small amount of incendiary charge 208 in the ogive section of the projectile allows for the initiation of the high explosive charge 226 upon impact with a thin skinned target, such as an aircraft.

The projectile 20 is similar to the projectile 10 shown in FIG. 1 with the warhead assembly and tracer assembly being unchanged; however, as with all of the embodiments, the composition and amounts of the charges may be tailored to the specific performance desired. The hardened segmented penetrator 204 comprises a penetrator tip 2042 with a hollow cavity which aligns with the hollow cavity 2046 of the penetrator bases 2044. The incendiary charge 208 is housed in either or both of the hollow cavities of the hardened segmented penetrator 204.

Upon engagement with a thin skinned target, the nose cap 202 deforms to ignite the incendiary charge 208. The hollow interior of the penetrator tip 2042, penetrator base 2044 and closure plug 206 allow propagation of the incendiary charge 208 through to the initiating charge 224 and explosive charge 226.

If the projectile 20 does not engage a target, the self-destruct mechanism functions as in the projectile 10 of FIG. 1 with the tracer charge heating a web of metal between the tracer charge 230 and the self-destruct initiation charge 228 which in turn ignites the explosive charge 226.

Figure 3:
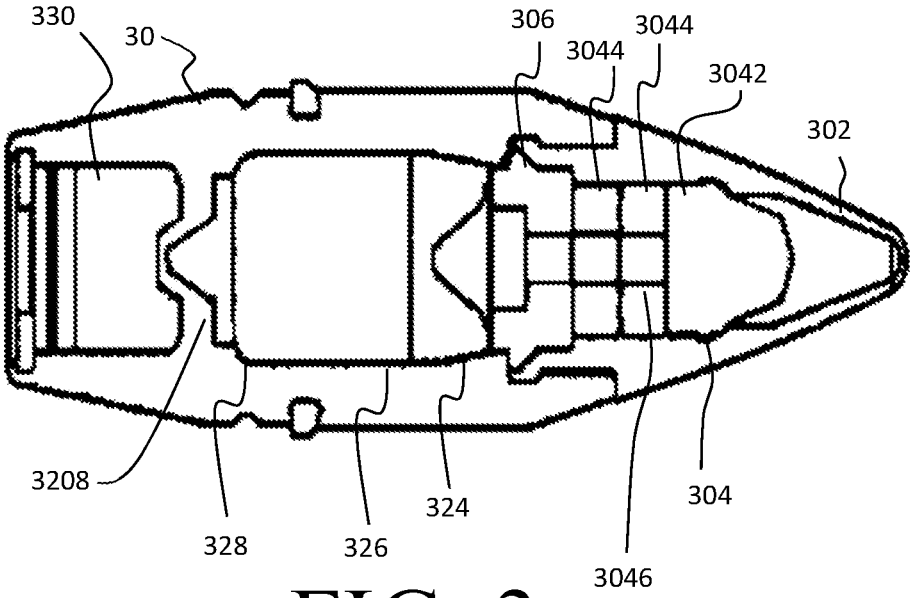
FIG. 3 is a side cross-sectional view of a medium caliber multi-purpose traced self-destruct projectile with a three piece solid penetrator design, in accordance with one embodiment.

FIG. 3 is a side cross-sectional view of a medium caliber multi-purpose traced self-destruct projectile with a three piece solid penetrator design, in accordance with one embodiment. In this embodiment, the penetrator tip incorporates a metal composite, such as a reactive metal, for greater incendiary effect The projectile 30 is similar to the projectile 10 shown in FIG. 1 with the arrangement of the warhead assembly and tracer assembly being unchanged; however, as will all of the embodiments, the composition and amounts of the charges may be tailored to the specific performance desired. The hardened segmented penetrator comprises two bases 3044 and a penetrator tip 3042 which is formed from a material including a reactive metal. The addition of the reactive metal increases the incendiary performance of the projectile in comparison to a heavy metal tip. The penetrator tip with reactive metal is relatively lighter than a heavy metal penetrator and therefore less of a risk in a situation where the round does not engage a target and must self-destruct.

Upon engagement with a target, the energetic chain is initiated and after a predetermined delay, the explosive charge 326 is detonated. The penetrator tip increases the incendiary effect of the round. The penetrator bases may be formed of a heavy metal alloy to increase the kinetic energy of the round or alternatively may incorporate a reactive metal to further increase the incendiary effect.

If the projectile 30 does not engage a target, the self-destruct mechanism functions as in the projectile 10 of FIG. 1 with the tracer charge heating a web of metal between the tracer charge 330 and the self-destruct initiation charge 328 which in turn ignites the explosive charge 326.

Figure 4:
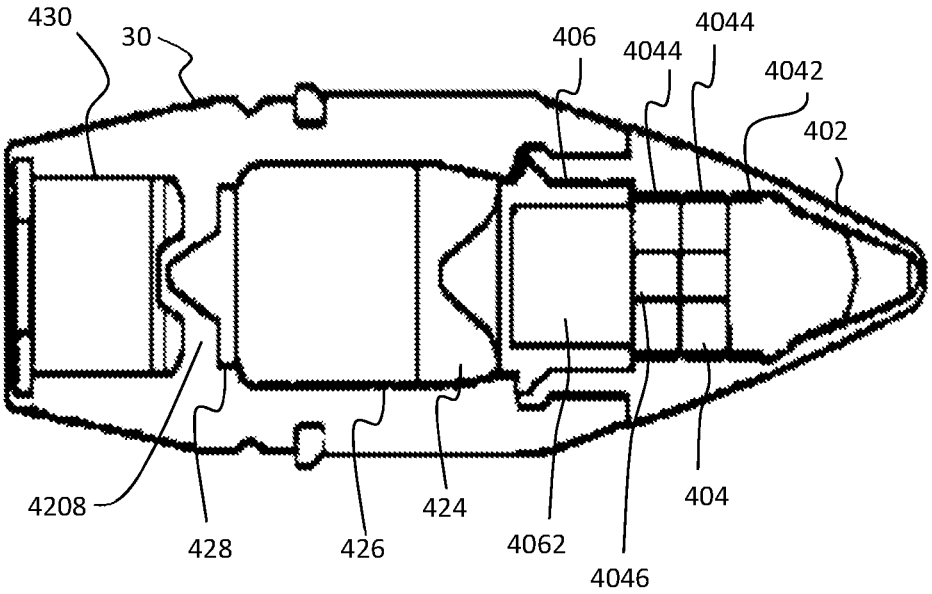
FIG. 4 is a side cross-sectional view of a medium caliber multi-purpose traced self-destruct projectile with a solid closure plug, in accordance with one embodiment.

FIG. 4 is a side cross-sectional view of a medium caliber multi-purpose traced self-destruct projectile with a solid closure plug, in accordance with one embodiment. Alternate closure plug geometries enhance the interaction with the explosive train and cause the explosive to react with more energy. The closure plug 408 further comprises a solid fill 410. The projectile comprises a penetrator tip formed from a heavy metal alloy and a closure plug which. incorporates a reactive metal for greater explosive effect.

The projectile 40 is similar to the projectile 10 shown in FIG. 1 with the arrangement of the warhead assembly and tracer assembly being unchanged; however, as will all of the embodiments, the composition and amounts of the charges may be tailored to the specific performance desired. The hardened segmented penetrator 404 comprises two bases 4044 and a penetrator tip 4042 which is formed from a heavy metal alloy. The closure plug 406 includes a hollow cavity filled with reactive metal fill 4062. The addition of the reactive metal fill 4062 interacts with the explosive charge 426 to increase the explosive reaction and performance of the round.

Upon engagement with a target, the energetic chain is initiated and after a predetermined delay, the explosive charge 426 is detonated. The reactive metal fill 4062 interacts with the explosive charge 426 to increase the explosive reaction.

If the projectile 40 does not engage a target, the self-destruct mechanism functions as in the projectile 10 of FIG. 1 with the tracer charge 430 heating a web of metal 4208 between the tracer charge 430 and the self-destruct initiation charge 428 which in turn ignites the explosive charge 426.

While the invention has been described with reference to certain embodiments, numerous changes, alterations and modifications to the described embodiments are possible without departing from the spirit and scope of the invention as defined in the appended claims, and equivalents thereof.

What is claimed is:

1. A projectile for an ammunition round, the projectile comprising:

a nose assembly further comprising
- a nose cap,
- a hardened segmented penetrator positioned within the nose cap, and
- a closure plug securing the hardened segmented penetrator within the nose cap;

a warhead assembly rearward of the nose assembly and further comprising
- a body which partially receives the nose assembly, and
- a dual purpose explosive charge assembly housed within the body for extending the ballistic effect of the projectile when a target is engaged and for self-destructing the projectile when a target is not engaged;

a tracer assembly housed within a cavity in the base of the body and further comprising
- a tracer charge for tracing a projectile trajectory and initiating the dual purpose explosive charge when a target is not engaged; and wherein the closer plug further comprises a support rim in contact with the both for preventing rearward axial movement of the closure plug and upon impact with a target, the support rim is configured for shearing thereby allowing rearward axial movement of the closure plug such that after engaging a target, the explosive charge is initiated by impact with the closure plug.

2. The projectile of claim 1 wherein the hardened segmented penetrator further comprises a penetrator tip and one or more penetrator bases.

3. The projectile of claim 1 wherein the hardened segmented penetrator is formed from a tungsten alloy.

4. The projectile of claim 1 wherein the explosive charge is initiated after a predetermined delay upon the projectile engaging a target.

5. The projectile of claim 2 wherein the one or more penetrator bases define a hollow interior.

6. The projectile of claim 5 wherein the penetrator tip is hollow and aligned with the hollow interior of the one or more penetrator bases thereby forming an interior volume in the hardened segmented penetrator and wherein the interior volume is filled with an incendiary charge configured for facilitating initiation of the explosive charge assembly upon impact with a thin skinned target.

7. The projectile of claim 2 wherein the penetrator tip is formed from a reactive metal.

8. The projectile of claim 1 wherein the closure plug is hollow.

9. The projectile of claim 1 wherein the closure plug is filled with a reactive metal which interacts with the explosive charge assembly.

10. The projectile of claim 1 wherein the explosive charge assembly further comprises an initiating charge positioned at a front end of the explosive charge assembly, a self-destruct initiating charge positioned at a rear end of the explosive charge assembly and an explosive charge positioned between the initiating charge and the self-destruct initiating charge.

11. The projectile of claim 10 wherein the initiating charge is initiated by an impact with the closure plug and in turn initiates the explosive charge.

12. The projectile of claim 10 wherein after a predetermined time without engaging a target, the tracer charge heats a portion of the body between the tracer charge and the self-destruct initiating charge to a temperature sufficient to initiate the self-destruct initiating charge which in turn initiates the explosive charge.

13. A projectile for an ammunition round, the projectile comprising:

a nose assembly further comprising
- a nose cap,
- a hardened segmented penetrator positioned within the nose cap and further comprising a penetrator tip and one or more penetrator bases, the one or more penetrator bases defining a hollow interior, and
- a closure plug securing the hardened segmented penetrator within the nose cap;

a warhead assembly rearward of the nose assembly and further comprising
- a body which partially receives the nose assembly, and
- a dual purpose explosive charge assembly housed within the body for extending the ballistic effect of the projectile when a target is engaged and for self-destructing the projectile when a target is not engaged;

a tracer assembly housed within a cavity in the base of the body and further comprising
- a tracer charge for tracing a projectile trajectory and initiating the dual purpose explosive charge when a target is not engaged; and wherein the penetrator tip is hollow and aligned with the hollow interior of the one or more penetrator bases thereby forming an interior volume in the hardened segmented penetrator and wherein the interior volume is filled with an incendiary charge configured for facilitating initiation of the explosive charge assembly upon impact with a thin skinned target.

14. The projectile of claim 13 wherein the explosive charge assembly further comprises an initiating charge positioned at a front end of the explosive charge assembly, a self-destruct initiating charge positioned at a rear end of the explosive charge assembly and an explosive charge positioned between the initiating charge and the self-destruct initiating charge.

15. The projectile of claim 14 wherein the initiating charge is initiated by an impact with the closure plug and in turn initiates the explosive charge.

16. The projectile of claim 14 wherein after a predetermined time without engaging a target, the tracer charge heats a portion of the body between the tracer charge and the self-destruct initiating charge to a temperature sufficient to initiate the self-destruct initiating charge which in turn initiates the explosive charge.

17. A projectile for an ammunition round, the projectile comprising:

a nose assembly further comprising a nose cap, a hardened segmented penetrator positioned within the nose cap and further comprising a penetrator tip and one or more penetrator bases, and a closure plug securing the hardened segmented penetrator within the nose cap;

a warhead assembly rearward of the nose assembly and further comprising a body which partially receives the nose assembly, and a dual purpose explosive charge assembly housed within the body for extending the ballistic effect of the projectile when a target is engaged and for self-destructing the projectile when a target is not engaged;

a tracer assembly housed within a cavity in the base of the body and further comprising a tracer charge for tracing a projectile trajectory and initiating the dual purpose explosive charge when a target is not engaged; and wherein the closure plug is filled with a reactive metal which interacts with the explosive charge assembly.

18. The projectile of claim 17 wherein the explosive charge assembly further comprises an initiating charge positioned at a front end of the explosive charge assembly, a self-destruct initiating charge positioned at a rear end of the explosive charge assembly and an explosive charge positioned between the initiating charge and the self-destruct initiating charge.

19. The projectile of claim 18 wherein the initiating charge is initiated by an impact with the closure plug and in turn initiates the explosive charge.

20. The projectile of claim 18 wherein after a predetermined time without engaging a target, the tracer charge heats a portion of the body between the tracer charge and the self-destruct initiating charge to a temperature sufficient to initiate the self-destruct initiating charge which in turn initiates the explosive charge.

* * * * *